US005443108A

United States Patent [19]

LeVert et al.

[11] Patent Number: 5,443,108

[45] Date of Patent: Aug. 22, 1995

[54] UPWARDLY DEPLOYED PRIVACY BLIND

[76] Inventors: Francis E. LeVert, 1909 Matthew La., Knoxville, Tenn. 37923; Richard J. LeVert, 7320 S. Merrill, Chicago, Ill. 60649; Francis E. LeVert, II, 1909 Matthew La., Knoxville, Tenn. 37923

[21] Appl. No.: 69,769

[22] Filed: Jun. 1, 1993

[51] Int. Cl.[6] ..... E06B 9/26

[52] U.S. Cl. ..... 160/167

[58] Field of Search ..... 160/167 R, 172 R, 168.1 R, 160/170 R, 176 R, 178.1 R, 115, 84.03, 84.06

[56] References Cited

U.S. PATENT DOCUMENTS

| | | | |
|---|---|---|---|
| 2,283,640 | 5/1942 | Kwon | 160/167 R |
| 2,920,695 | 1/1960 | Bennett | 160/167 R |
| 3,093,186 | 6/1963 | Castanedo | 160/167 R |
| 3,192,991 | 7/1965 | Anderle | 160/167 R |
| 3,552,473 | 1/1971 | Persson | 160/172 R X |
| 3,818,969 | 6/1974 | Debs | 160/172 R X |

*Primary Examiner*—David M. Purol

[57] ABSTRACT

A Venetian blind consisting of a plurality of slats, a movable head, two string ladders one each attached proximate the first and second ends of the movable head and a stationary bottom unit, two fully extended vertical alignment strings one each attached proximate the first and second ends of the stationary bottom unit and extending vertically through holes in the plurality of slats and the movable head up to the receiving cavity of a stationary upper member and attached thereto, a draw string connected to the movable head and extending through a draw string holding mechanism mounted in the stationary upper member for varying the collapsed height of the plurality of slats and a tilt adjusting mechanism contained in the movable head for varying the tilt of the uncollapsed height of slats is described. The Venetian blind will provide privacy against line-of-sight viewing by persons external to the dwelling while at the same time allowing full passage of ambient light and thermal radiation through the upper portions of the window. The blind, which is designed to be upwardly extended from a collapsed height in the lower portion of a window framework, is designed to permit full entry of thermal radiation and ambient light through all daylight hours of the day.

5 Claims, 7 Drawing Sheets

UPWARDLY DEPLOYED PRIVACY BLIND

BACKGROUND OF THE INVENTION

This invention relates to Venetian blinds, in particular, to venetian blinds that are deployed from the lower half of a window. That is, a blind that is extended upwardly toward the top of a window framework before tilting the slats to achieve full or partial privacy.

In the operation of most commercial blinds, a plurality of string ladders connected to fixed top and movable bottom horizontal units are used to provide support for slats, which when tilted, provides privacy for occupants. To achieve privacy at the lower region of a window, the bottom units of conventional blinds must be extended accordingly and all of the slats tilted to avoid a line of sight viewing from without. There have been several inventions designed to provide for partial tilting for a limited number of slats on a blind. Some of these systems are shown in U.S. Pat. No. 4,940,070 to S. L. Warden, U.S. Pat. No. 4,621,672 to Hsu and U.S. Pat. No. 2,579,485 to H. W. Fergurson et al. These systems require, in some cases, considerable modifications to existing mechanisms before they can be successfully deployed. Moreover, because of their deployment from the top of a window, they cannot provide the degree of ambient light and thermal radiation penetration afforded by the blind of this invention.

It is therefore an object of the present invention to provide an improved modification to Venetian blinds whereby the string ladders containing a plurality of slats are upwardly extended from the bottom of a window.

Another object of the present invention is to provide an improved blind that provides privacy for users from outside pedestrian traffic while permitting ambient light to enter the room from the upper portion of the window.

A still further object of this invention is to provide a low cost passive solar heating system by allowing thermal radiation to enter a room through the upper portion of a window while providing privacy for persons whose standing or sitting head height is below a certain blind extension level.

Other objectives of the invention will become obvious during the detailed description of the invention.

SUMMARY OF THE INVENTION

This invention concerns a significant change in the design and manner in which Venetian blinds are deployed in offices and dwelling units. In accordance with the invention of this disclosure, the blind consisting of a plurality of slats connected by two or more string ladders that are attached to a movable head assembly and a stationary bottom unit is deployed upwardly by pulling a drawstring attached to a movable head in a vertical direction away from a collapsed position in the lower portion of a window framework.

The drawstring is drawn through an ordinary drawstring clamping mechanism mounted in an upper member that prevents slippage of the drawstring once the height of the movable head is selected. The slats defining the uncollapsed height of the blind are tiltable in a clockwise or counterclockwise direction by a worm screw gear set that rotates a cylindrical bar unit that extends substantially the full length of the movable head and moves the slats supported by the extended string ladders. This invention provides for privacy by preventing line-of-sight viewing into a dwelling or office through the lower portion of a window when the tilt angle of the uncollapsed height of slats is set. In addition to providing privacy, the blind allows ambient light and when desired thermal radiation to enter the dwelling or office via the top portion of a window. The invention thereby makes it possible for users to capture early morning light and thermal radiation to increase passive solar heating without compromising privacy.

In the preferred embodiment, the blind is deployed by drawing a movable head to the desired vertical height and tilting the slats carried by the string ladder system in an uncollapsed zone to provide privacy.

DETAILED DESCRIPTION

Figure 1:
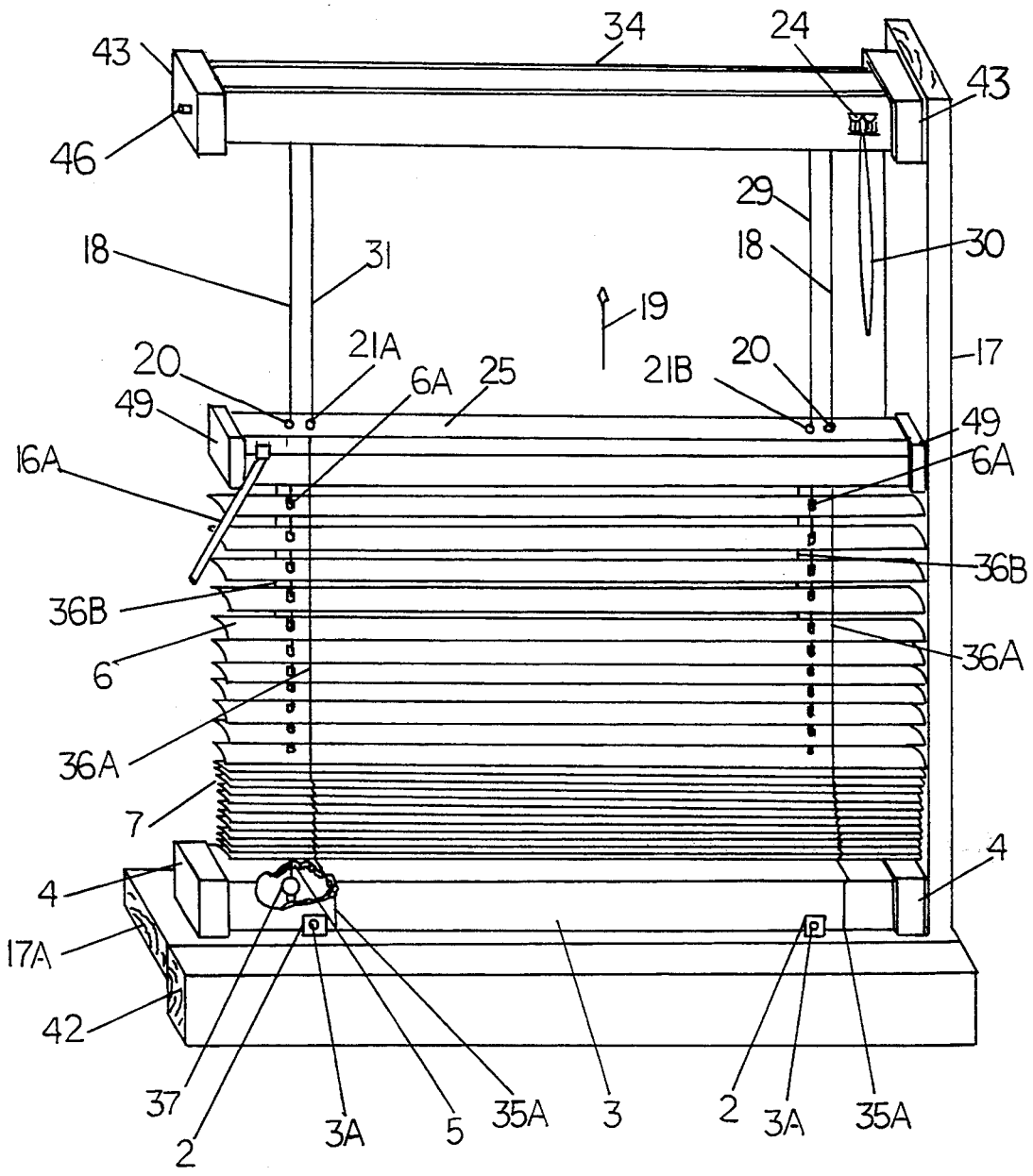
FIG. 1 is a front elevation view of a Venetian blind in accordance with this invention in which the blind is partially deployed with slats in the uncollapsed zone tilted counterclockwise.
Figure 7:
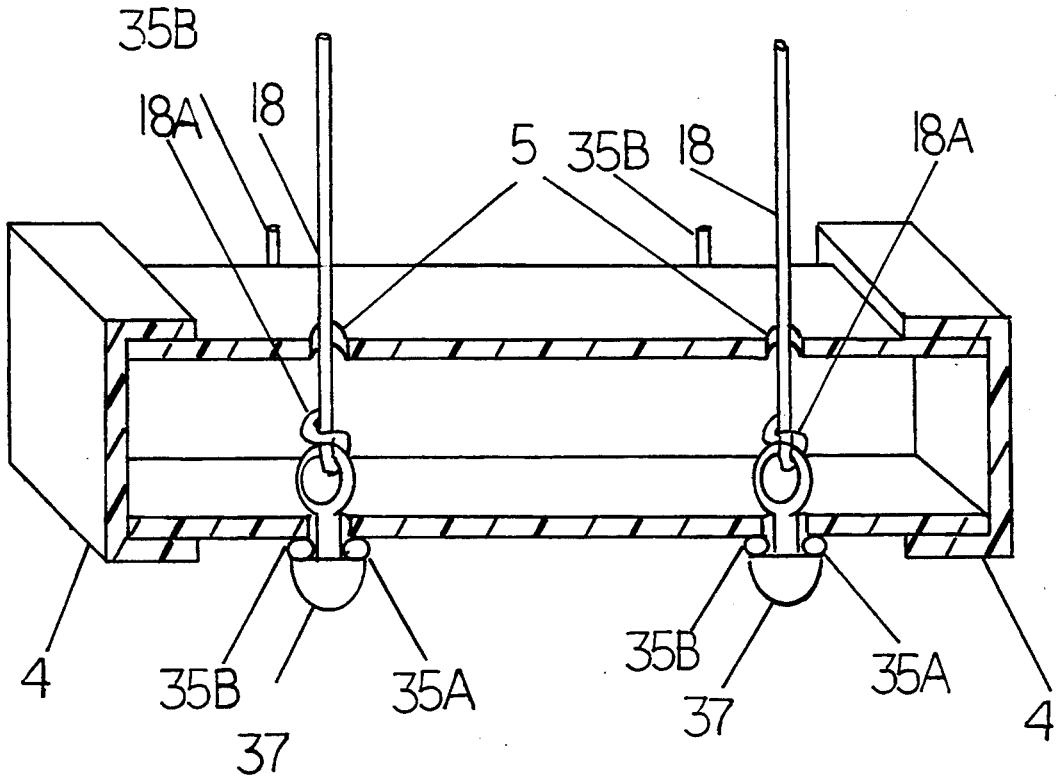
FIG. 7 is a cross section view of the bottom member showing termination of slat alignment strings and string ladders.

Attention is first directed to FIG. 1 that shows a front view of the blind of this invention as viewed from a position within a dwelling or office building. In FIG. 1, mounting brackets 2 are used to hold bottom unit 3 in a fixed position on bottom element 17A of window framework 17 by using ordinary wood screws 3A. The first and second ends of bottom unit 3 are covered with end caps 4. The bottom unit 3 has through holes 5 as shown in FIG. 1 and FIG. 7. The lower terminal ends 35A of the ordinary string ladders 36 are designed to be inserted into the holes 5 on the bottom surface of bottom unit 3 where they are locked in place by pressure fit pins 37 shown in FIGS. 1 and 7. The first ends of slats alignment strings 18, which extends through oval holes 6A proximate to the first and the second ends of the 6, are terminated by separate knots 18A (See FIG. 7) in the interior of bottom unit 3. While the bottom unit 3 in FIG. 1 is a long hollow rectangular tube, it could take the form of be a hollow tube with an oval cross sectional area. It could also be made of metal or plastic. FIG. 1 shows the blind mounted in the framework 17 of a window, however, it could just as well be mounted on the casing 42 of a window.

Figure 2:
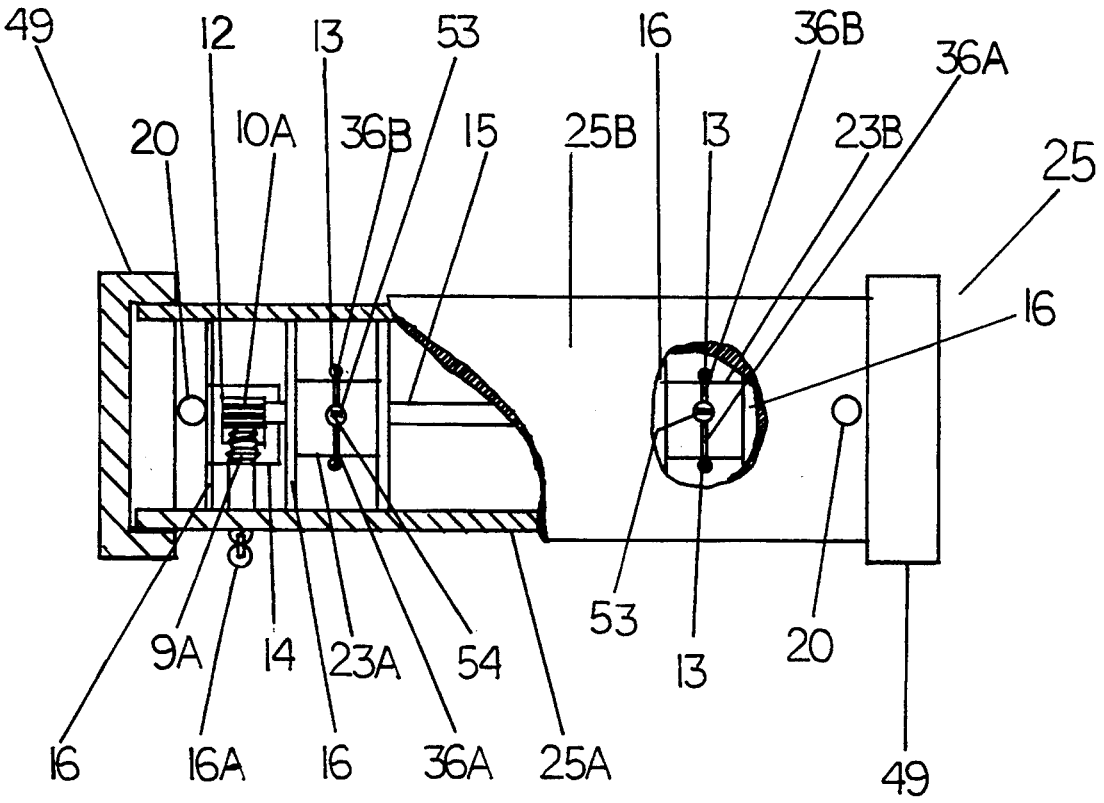
FIG. 2 is a partial sectional view of the movable head showing the tilt mechanism and through holes for accepting vertical alignment strings.
Figure 3:
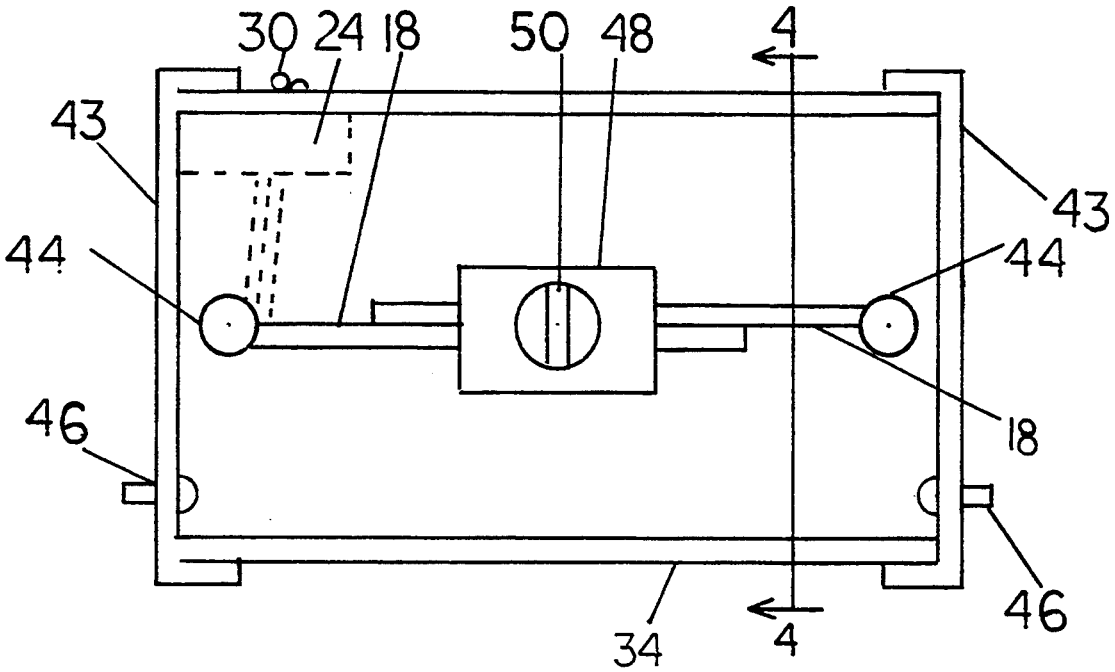
FIG. 3 is a top view of the upper member for receiving the movable head when the blind is fully extended.

To hold the slats 6 of the blind vertically disposed above each other, the second ends of strings 18 extend through holes 44 of upper member 34 shown in FIG. 3. Before being inserted through holes 44, the alignment strings 18 are inserted through holes 20 located in the capping unit 25B and lower half 25A of therefor movable head assembly 25 given in FIG. 2. After the first ends of alignment strings 18 are terminated as by knots in the interior of an installed bottom unit 3, the second ends of the alignment strings 18 are held taut by clamping unit 48 in upper member 34 which holds alignment strings 18 in non slipping compression when connected by metallic screw 50. The clamping unit 48 of this invention was made of plastic, however, it could have been constructed using metallic components. The movable head assembly 25, the plurality of slats 6 and bottom unit 3 are flexibly connected by string ladders 36 of FIGS. 1 and 6. The string ladders 36, which are made of a polymeric or a suitable material, consist of a front ladder string 36A (as viewed from the interior of a dwelling unit) and a back ladder string 36B connected at regular equal intervals by cross strings 36C. When two string ladders are used in the construction of a blind, the openings 36D in the ladders 36 are designed to receive the ends of slats 6. The cross strings 36C are designed to support the slats when the collapsed height 7 (see FIGS. 1, 5 and 6) of the slats 6 and string ladder 36 is altered by changing the vertical position of movable head assembly 25. The ladders 36 are attached to the bottom unit 3 as discussed above. Depending on the lengths of the slats employed in a blind, it may be necessary to use more than two laterally disposed string ladders.

The top terminal ends front and back ladder strings 36A and 36B are inserted through holes 13 into the internal volume of movable head 25 where they are attached to spools 23A and 23B as shown in FIG. 2. Spools 23A and 23B are an integral parts of an ordinary slat tilting mechanism. The tilting mechanism consists of a worm gear set 12 contained in plastic housing 14, a metallic rod 15 and plastic spools 23A and 23B. A cut away view of the components of the tilting mechanism is shown in FIG. 2. The plastic gear 10A is designed to accept, with non slippage contact, the metallic rod 15 which extends through support pieces 16 located near the first and second ends of movable head assembly 25 as shown in FIG. 2. Movable head assembly 25 is designed to accept one each of the top terminal ends of front and back ladder strings of first and second string ladders 36 for attachment to spools 23A and 23B. Set screws 54 apply non-slipping contact to the terminal ends of first and second string ladders 36 and spools 23A and 23B when they are inserted into holes 53. Spools 23A and 23B are disposed, one each, directly above a string ladders 36 in an assembled blind "such that they are allineated one each with through holes 5 of bottom unit 3, oval holes 6A of slats 6 and holes 44 of upper member 34, respectively". The rotation of spools 23A and 23B results in the movement of the front strings 36A of string ladder 36 with respect to the back string 36B. This relative movement causes the uncollapsed slats to tilt relative to a horizontal plane.

Operation of the tilting mechanism is achieved by manually rotating wand 16A of FIG. 1 in a clockwise or counterclockwise manner. The rotation of wand 16A drives worm gear 9A which in turn drives gear 10A. Capping unit 25B of FIG. 2 covers the upper half of movable head assembly 25 by overlapping the lower half 25A of the movable head assembly 25. End closure caps 49 are rigidly attached to the first and second ends of movable head assembly 25.

Figure 4:
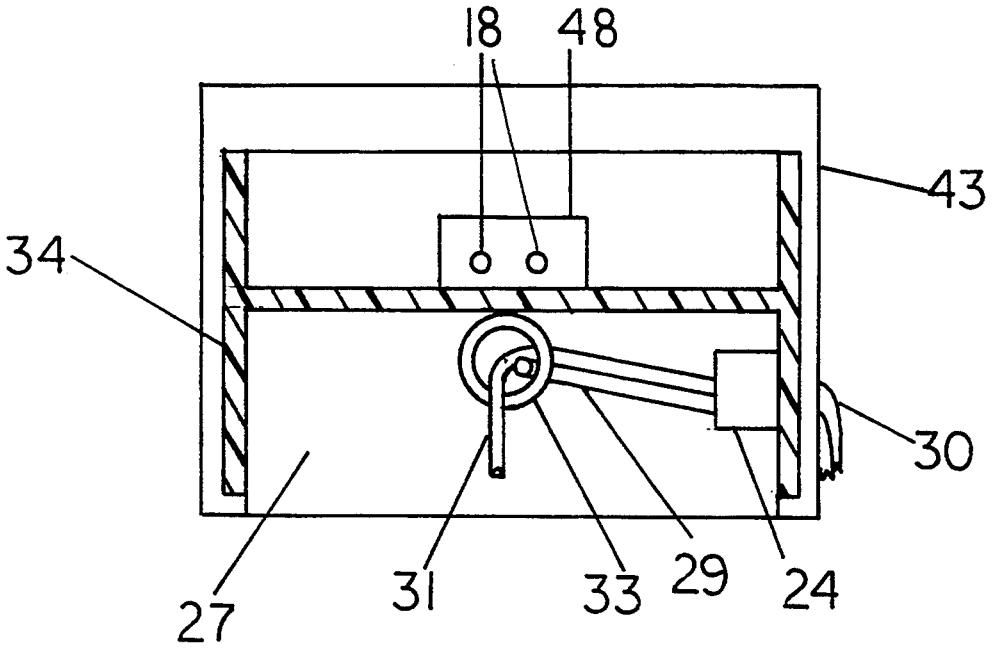
FIG. 4 is a cross sectional view of upper member along line 4–4.

When the blind is fully extended, the movable head assembly 25 is drawn into cavity 27 of upper member 34 shown in FIG. 4. The extended blind is held in such position by drawstring 30 which is held by common drawstring holding mechanism 24. The support ends 43 of upper member 34 may be rigidly connected to the window framework 17 or casing 42 by ordinary wood screws 46.

Figure 5:
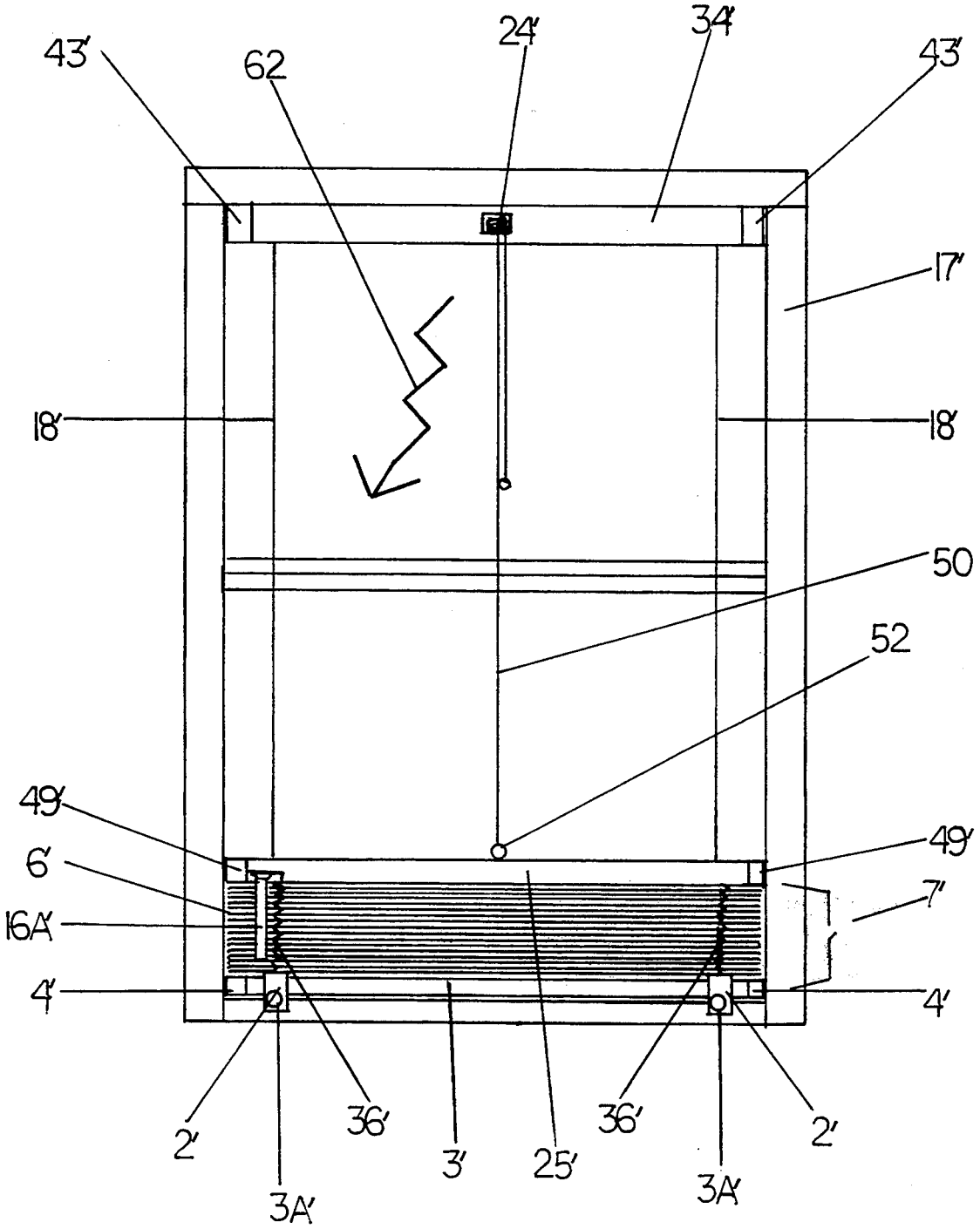
FIG. 5 is a front view of the blind described in the second embodiment of this invention with the slats in a fully collapsed position.
Figure 6:
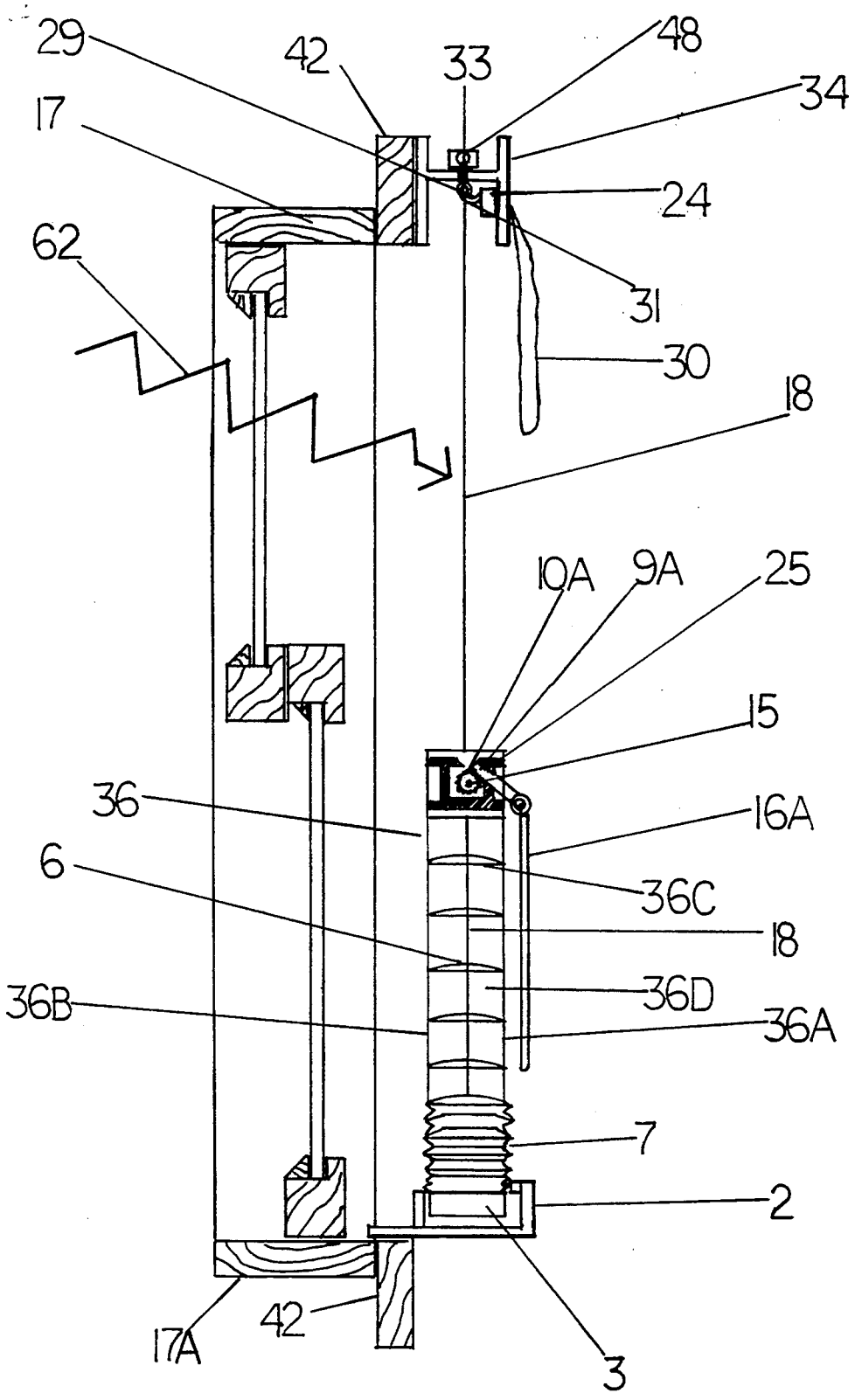
FIG. 6 is a side cross sectional view of the blind in the first embodiment of this invention installed in a window framework.

The axial center of movable head assembly 25, when moved in direction 19, slides in a vertical plane defined by alignment strings 18. Movable head assembly 25 is raised and lowered via over lapping lengths of drawstring 30 defined by numerals 29 and 31. They are here after referred to as drawstring elements 29 and 31. Drawstring element 31 extends across the inner surface of cavity 27 and is held by retainer 33. The movable head assembly 25 is raised or lowered by drawstring elements 29 and 31, which are rigidly attached to movable head assembly 25 as by retainers 21A and 21B, respectively, acting in concert. FIG. 5 shows the second embodiment of the device of this invention. When the movable head 25' is lowered to the bottom of window framework 17', the slats 6' string ladders 36' and movable head assembly 25 form a total collapsed height 7' per FIG. 5.

Figure 8:
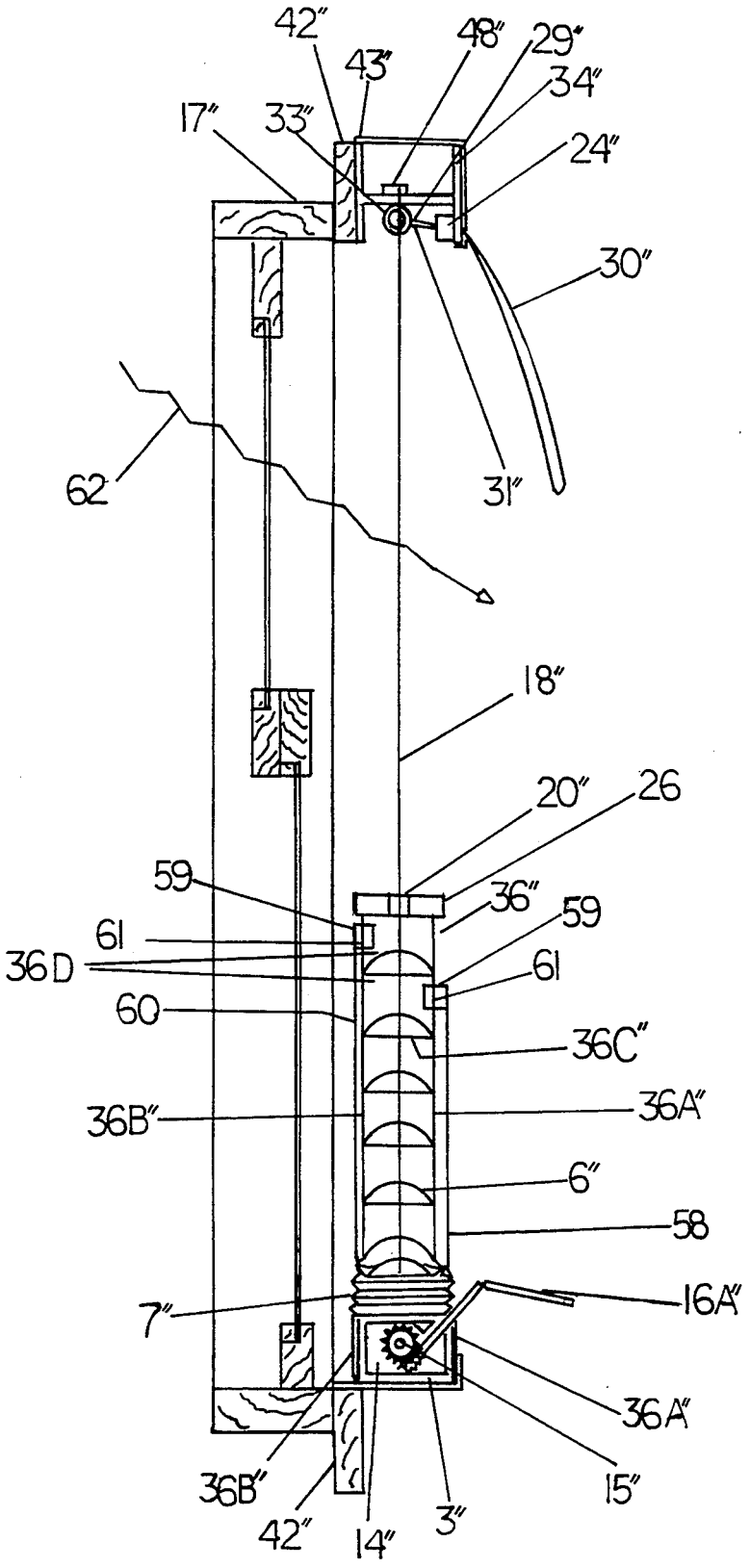
FIG. 8 is a cross section view of the bottom member showing the tilting mechanism of the third embodiment of the device of this invention.

The tilting mechanism shown schematically in FIG. 2 in the first embodiment of this invention was mounted in the movable head assembly 25. It, however, as shown in FIG. 8 in the third embodiment, could have been mounted in the bottom unit 3'. FIG. 8 shows a cross sectional view of the tilt mechanism mounted in the bottom unit 3'' wherein the lower terminal ends 36A'' and 36B'' of the string ladders 36'' circumscribes the bottom unit 3 where they are mechanically attached to each other. The first ends of tilt strings 58 and 60 are attached with plastic ties 59 which are held together as by adhesive 61 to the front and back strings of the string ladder 36'' in the first and second openings 36D proximate the movable rail 26, respectively, of each of the string ladders 36''. In a manner similar to that in FIG. 2, the second ends of tilt strings 58 and 60 are attached to spools a tilt mechanism enclosed in bottom unit 3. The rotation of metallic rod 15'' results in the tilting of slats 6'' below the point of attachment of the tilting strings 58 and 60 to the front and back strings 36A'' and 36B'' of the string ladders 36''. In this third embodiment movable head assembly 25 of the first embodiment is replaced by movable rail 26 which is connected to drawstring elements 29' and 31'. The movable rail contains alignment holes 20'' for accepting vertical alignment strings 18'' . The first and second ends of movable rail 26 are attached to two or more laterally disposed string ladders.

In the first embodiment of the upwardly deployed blind, the two terminal ends of a looped string that defines drawstring 30 are described by drawstrings elements 31 and 29, which are attached to the first and second ends of movable head assembly 25 via retainers 21A and 21B. The drawstring could consist of the single unlooped string 50 of FIG. 5 with a first end attached midway movable head assembly 25'. In the device of FIG. 5, the second end of drawstring 50 is extended vertically after being attached to eyebolt 52, which is attached to movable head assembly 25', and extended through drawstring holding mechanism 24', which is mounted at the axial center of top member 34'. The free end of drawstring 50 hangs freely after passing through holding mechanism 24'.

The operations of the device of the first embodiment of this invention as presented in FIG. 1 will now be explained. In a collapsed position similar to that shown in FIG. 5, the movable head assembly 25 and the plurality of slats 6 are reposed at the bottom of the window framework 17 along with bottom unit 3. The horizontal slats 6 and movable head assembly 25 are held in a vertical direction centered around a vertical plane defined by alignment strings 18. When the drawstring's elements 29 and 31 are pulled taut by applying a pulling force to the drawstring 30 greater than that of the force of gravity on the movable head assembly 25 and slats supported by the first and second string ladders 36 and the frictional forces of the holding mechanism on the drawstrings 30, the vertical height of the blind may be selected as by the user. When the desired height for the movable head assembly 25 is reached where tilting of the slats will provide the necessary privacy, lengths of drawstring elements 29 and 31 are held fixed by holding mechanism 24. Deploying the blind in this manner allows the upper region of a window to provide full entrance of outside ambient light and thermal radiation 62 as shown in FIG. 5. The slats in the lower portion of the window, when tilted, provides a line-of-sight privacy protection against persons outside the interior space. The blind may also be fully extended covering the total window with or without tilted slats.

From the foregoing, it should be apparent to a person skilled in the art, that a privacy blind capable of providing privacy and maximum use of ambient light as well as increasing passive solar heating of interior spaces of dwellings and offices have been developed. Although only a limited number of specific embodiments have been described in detail, such description is not to be taken as a limitation of the present invention. Rather, the scope of the invention is to be defined by the appended claims and their equivalents.

I claim:

1. A window blind that is deployed from the bottom of a window comprising:

an upper member mounted at the top of a window, said upper member having one aperture proximate the respective ends of the upper member and a downwardly facing cavity that extends substantially the full length of the upper member;

a drawstring holding mechanism incorporated in said cavity of the upper member;

a movable head assembly with one aperture juxtaposed near each end of said movable head assembly with the geometrical centers of said apertures of the movable head assembly collinear with the geometrical centers of said apertures of the upper member;

a plurality of slats having one oval hole proximate the respective ends of said slats with the geometrical centers of said oval holes collinear with the geometrical centers of the apertures of the movable head assembly;

two string ladders with extended top and bottom terminal ends comprising front and back ladder strings connected by cross strings at equal intervals for supporting the slats with said cross strings distant from said extended top and bottom terminal ends of said string ladders;

a slat tilt mechanism incorporated in the movable head assembly operably attached to the top terminal ends of said string ladders for tilting the slats;

a bottom unit mounted in the lower portion of a window with said bottom terminal ends of the string ladders mechanically attached thereto proximate the respective ends of said bottom unit;

alignment strings attached to the bottom unit and extended vertically through said oval holes in the slats, the apertures in the movable head assembly, and said apertures in the upper member where said alignment strings are mechanically coupled to the upper member for maintaining the horizontal axes of the slats and movable head assembly in a vertical plane; and, drawstring means, for varying the vertical position of the movable head and concurrently the disposition of the slats within a window, rigidly attached to the movable head and extending upward into the cavity of the upper member and through said drawstring holding mechanism where said drawstring means depends in a downward direction.

2. The window blind of claim 1 wherein said drawstring means consists of a looped string whose ends are attached, one each, proximate first and seconds ends of the movable head.

3. The window blind of claim 1 wherein said slat tilt mechanism is composed of a metal rod with a driven gear of a worm gear set and two plastic spools slidably mounted and fixed, as by adhesive, on said metal rod.

4. An improved Venetian blind providing line-of-sight privacy and passive solar heating comprising:

a bottom unit;

an upper member mounted in the upper portion of a window having a cavity which extends substantially the full length of the lower portion of said upper member;

a drawstring holding mechanism operably mounted in the upper member;

a movable head assembly with one alignment hole positioned proximate each end of said movable head assembly;

a plurality of slats having oval holes at each of their first and second ends;

two string ladders with extended top and bottom terminal ends with cross strings therebetween for supporting the first and second ends of said slats;

a bottom unit mounted in the lower portion of a window;

two alignment strings extending through said oval holes in the slats and the alignment holes in the movable head assembly that are attached, under tension, to said bottom unit and said upper member;

tilting means mounted in the interior of said movable head assembly for tilting the slats in a counterclockwise or clockwise direction relative to a horizontal plane; and, a looped drawstring attached to the first and second ends of said movable head assembly and extended vertically substantially parallel to said alignment strings into the cavity of the upper member and subsequently through said drawstrings holding mechanism;

means connected to the upper member for mounting said blind within the framework of a window; and means connected to the bottom unit for mounting the blind within the framework of a window.

5. A blind deployed from the bottom of a window comprising:

an upper member;

a bottom unit;

a movable rail, with alignment holes proximate the first and second ends of said movable rail;

two string ladders with extended top and bottom terminal ends comprising from and back ladder strings connected by cross strings at equal intervals with said extended top terminal ends of said string ladders mechanically attached to the movable rail;

a plurality of slats with alignment holes at their first and second ends supported by said cross strings of the string ladders;

two vertical alignment strings attached to said upper member and extended through said alignment holes in said movable rail and said slats and mechanically attached to said bottom unit;

One or more drawstrings attached to the movable rail; and slat tilting means mounted in the bottom unit and attached to the second ends of two tilt strings whose first ends extend up beyond the cross strings of said string ladders proximate the movable rail where said tilt strings are attached to said front and back ladder strings of the string ladders for rotating the slats in a clockwise or counterclockwise directions.

* * * * *